US005469673A

United States Patent [19]

Raynor et al.

[11] Patent Number: 5,469,673

[45] Date of Patent: Nov. 28, 1995

[54] INTEGRATED RESIDENTIAL DWELLING UNITS

[76] Inventors: Dennis L. Raynor, 101 W. Mission, Bellevue, Nebr. 68005; Dennis J. Hoth, 8420 W. Dodge Rd., Suite 207, Omaha, Nebr. 68114

[21] Appl. No.: 223,777

[22] Filed: Apr. 6, 1994

[51] Int. Cl.[6] ..... E04H 1/00

[52] U.S. Cl. ..... 52/79.7; 52/79.8; 52/169.2; 52/169.3

[58] Field of Search ..... 57/79.7, 79.8, 57/169.2, 169.3, 173.1

[56] References Cited

U.S. PATENT DOCUMENTS

| | | | |
|---|---|---|---|
| 3,678,639 | 7/1972 | Panitz | 52/169.2 X |
| 3,874,137 | 4/1975 | Gentry | 52/169.3 X |
| 3,996,709 | 12/1976 | Coxe | 52/79.7 X |
| 4,007,565 | 2/1977 | Finnegan | 52/169.3 |
| 4,345,407 | 8/1982 | Fishman | 52/169.3 |
| 4,685,260 | 8/1987 | Jenn | 52/169.3 |
| 4,736,556 | 4/1988 | Scizak | 52/169.3 X |
| 4,800,692 | 1/1989 | Jenn | 52/169.2 |

FOREIGN PATENT DOCUMENTS

| | | | |
|---|---|---|---|
| 0621962 | 6/1961 | Italy | 52/169.3 |

OTHER PUBLICATIONS

"The Patio House" Technical Bulletin No. 45 Urban Land Institute.

*Primary Examiner*—Wynn E. Wood

*Attorney, Agent, or Firm*—Zarley, McKee, Thomte, Voorhees & Sease; Mark D. Frederiksen

[57] ABSTRACT

A system of integrated residential dwelling units includes a pair of dwelling units with forward sides facing in generally opposite directions and rearward sides adjacent one another. An enclosed passageway connects the rearward sides of the dwelling units and includes at least one entryway from the exterior of the passageway externally of the dwelling units. Each dwelling unit includes a rearward entry into the passageway and a separate forward entry accessing the street in front of the dwelling units.

10 Claims, 2 Drawing Sheets

INTEGRATED RESIDENTIAL DWELLING UNITS

TECHNICAL FIELD

The present invention relates generally to housing structures, and more particularly to a structure which includes a plurality of individual living units connected by an enclosed spine to a central commons structure.

BACKGROUND OF THE INVENTION

It has long been said that one of the goals of the "American dream" is to purchase a home. However, individual residential units are not always the preferable residential living style for many people, especially the elderly and the handicapped. In an attempt to combine the desirable features of an individual residential home with the convenience and economic feasibility of multiple residential unit dwellings, a number of different residential structures have been developed.

The most common multiple dwelling unit structure currently available is the apartment building, wherein a plurality of individual residential living units are combined in a single enclosed structure. However, conventional apartment buildings do not provide both an exterior entrance to the apartment and a separate apartment entrance connected through an enclosed spine to an enclosed common area, nor maintain the individual visible identity of each residential unit.

Another type of multiple dwelling unit currently available includes town home structures, wherein a plurality of individual residential units are connected side by side with common demising walls (some times with attached garages) to form a single integrated structure. While town homes accomplish several goals over apartment structures-such as individual exterior entrances, grade level access, and some attached garages-they do not provide enclosed common access to an enclosed commons area, or enclosed common access to other residential units, separate from the exterior entrance.

SUMMARY OF THE INVENTION

It is therefore a general object of the present invention to provide integrated residential dwelling units with individual residential identity from the street similar to currect single family residential or duplexes, having an exterior entrance together with a separate enclosed passageway, common too all residential units and to an enclosed common area.

Yet another object of the present invention is to provide integrated residential dwelling units with separate exterior entrances, individual green space areas, and an attached garage.

Still another object of the present invention is to provide integrated residential dwelling units with enclosed passageways linking the units, and separate external entrances to the individual dwelling units.

These and other objects of the present invention will be apparent to those skilled in the art.

The system of integrated residential dwelling units of the present invention includes a pair of dwelling units with forward sides facing in generally opposite directions and rearward sides adjacent one another. An enclosed passageway connects the rearward sides of the dwelling units and includes at least one entryway from the exterior of the passageway externally of the dwelling units. Each dwelling unit includes a rearward entry into the passageway and a separate forward entry accessing the street in front of the dwelling units.

DESCRIPTION OF THE PREFERRED EMBODIMENT

Figure 1:
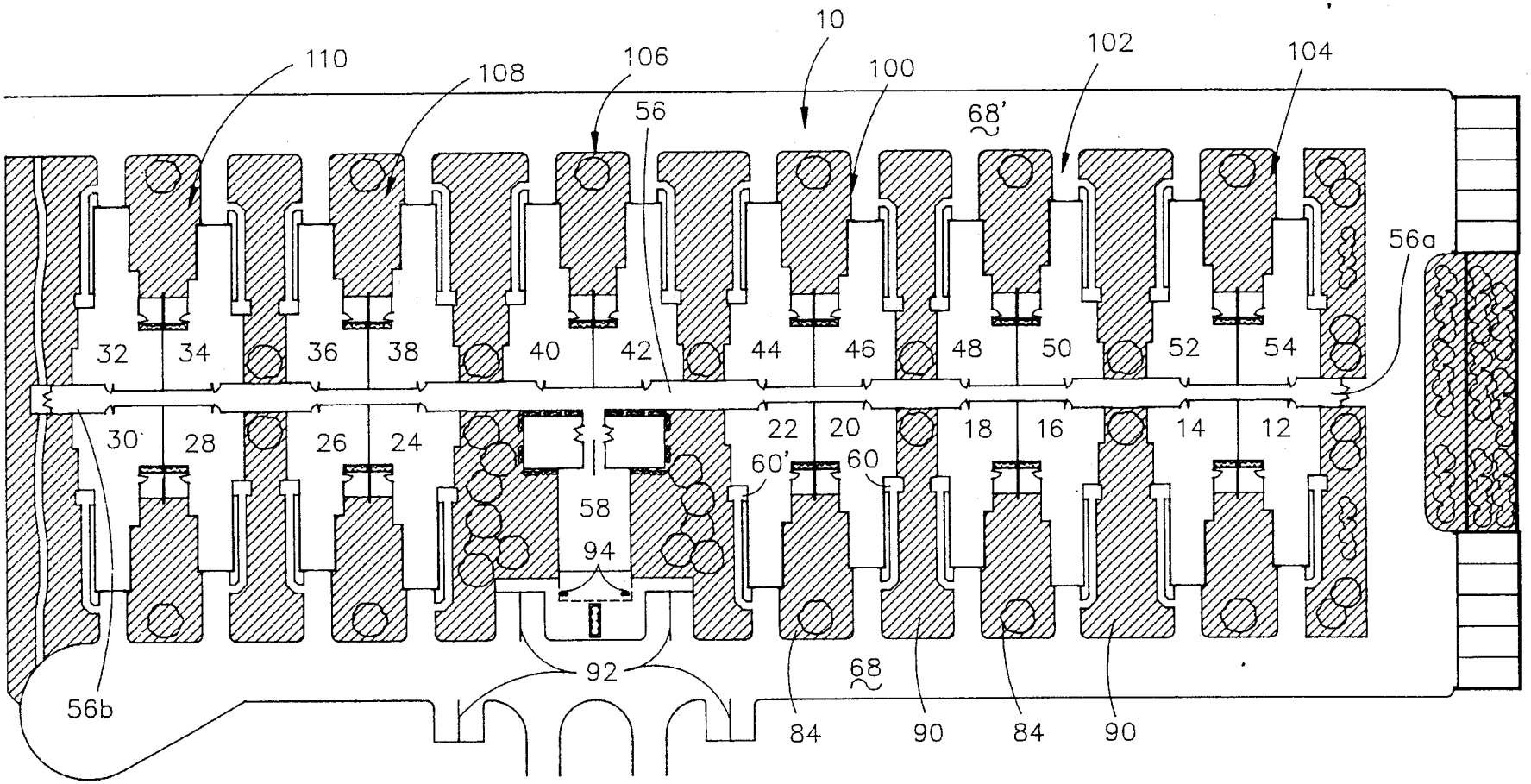

Referring now to the drawings, in which similar or corresponding parts are identified with the same reference numeral, and more particularly to FIG. 1, the integrated residential dwelling units of the present invention are designated generally at 10 in the site plan of FIG. 1, and include individual residential units 12–54, an enclosed spine structure designated generally at 56 and an enclosed commons building 58 connected to spine 56.

Figure 2:
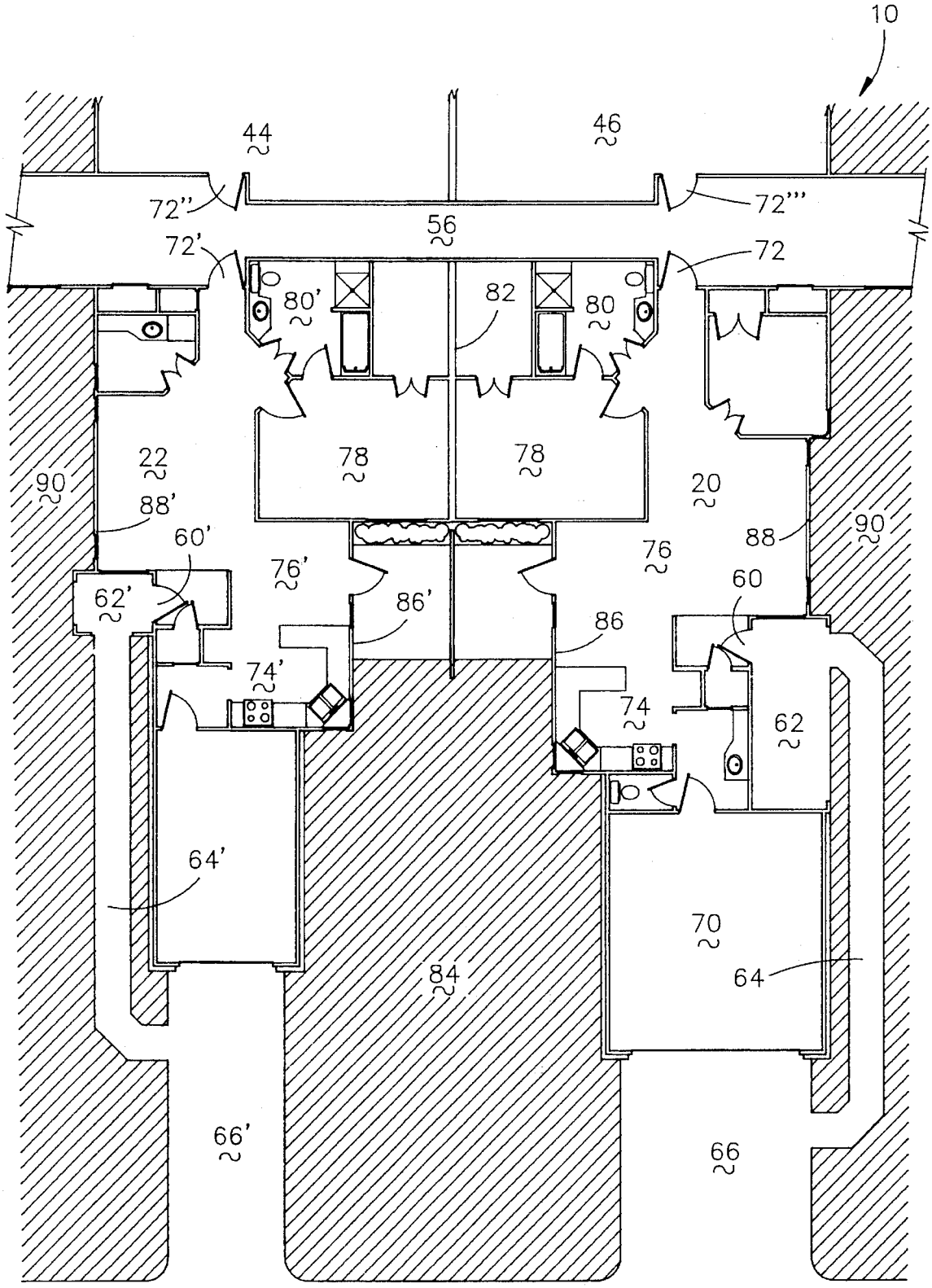

Referring now to FIG. 2, a pair of individual residential units 20 and 22 are shown in greater detail. Residential unit 20 includes an external entrance 60 to the unit 20, with an entry porch 62. A sidewalk 64 extends to a driveway 66, which in turn accesses a street 68. A garage 70 is attached to unit 20 and is shown with dimensions to hold two cars.

For the purposes of the description, the site of each residential unit facing the street 68 will be described as the "front". A rear entrance 72 opens onto an enclosed passageway forming spine 56 which extends along the rearward side of unit 20, as described in more detail hereinbelow.

The forward portion of unit 20 includes a kitchen area 74 and a living area 76, with at least one sleeping area 78 and a bathroom area 80 located in the rearward portion of the house. Unit 20 has a side wall 82 common with unit 22, and extending forwardly from the rearward wall of the unit. Forward of common wall 82 is a common green space 84 separating the forward portions of units 20 and 22. Green space 84 is an area including grass, trees, bushes, and/or other landscaping. The forward portion of unit 20 has a short side wall 86 extending forwardly from the rearward portion of the unit 20 which overlooks common green space 84. A long side wall 88, opposed to common wall 82 and side wall 86 extends from spine 56 forwardly to garage 70 and overlooks a large green space 90. Thus, residential unit 20 overlooks green spaces 84 and 90 on opposing sides and extends from spine 56 forwardly to garage 70.

Residential unit 22 includes all of the same elements as residential unit 20, although each element may take on a different configuration and size. Thus, unit 22 includes a front entrance 60', front porch 62', sidewalk 64', driveway 66', garage 70', rearward entrance 72', kitchen 74', living area 76', sleeping area 78', bathroom area 80', short side wall 86' and a long side wall 88'. Common wall 82 separates the sleeping and bathroom areas of units 20 and 22, while green space 84 separates side walls 86 and 86'. Similar to unit 20, residential unit 22 overlooks a common green space 84 and a larger green space 90 extending from spine 56 to street 68.

Spine 56 is an enclosed passageway which extends between residential units 20 and 22, and projects through large green spaces 90, as shown in FIG. 2. A pair of additional residential units 44 and 46, have rearward entrances 72" and 72'", respectively, which open onto spine 56. Thus, residents of residential units 20, 22, 44 and 46 may contact one another via spine 56 without having to go outdoors. On the other hand, guests visiting any individual units can access the individual unit through an exterior entrance 60.

Referring once again to FIG. 1, it can be seen that spine 56 interconnects all residential units 12–54, to permit access to any individual unit without having to venture outside. In addition, access to spine 56 may be achieved through end entrances 56*a* and 56*b*, separate from and externally of the dwelling units,0 or through an entrance 56*c* from commons building 58. Commons building 58 is preferably a closed area which can support a variety of activities, such as food service, recreational activities, or other community congregational gatherings. Preferably, additional parking 92 is provided adjacent to commons building 58, with an exterior entrance 94 provided to commons building 58.

In the preferred form of the integrated residential dwelling units 10, a pair of dwelling units 20 and 22 have a partial common wall and are opposed through spine 56 to a second pair of dwelling units 44 and 46. In this way, a set of four living units 20, 22, 44 and 46 may be considered as an independent building 100 interconnected to a plurality of similar buildings 102, 104, 106, 108 and 110 by enclosed spine 56. Each building 100–110, and commons building 58, are separated by a large green space 90, thereby maintaining the aesthetic appeal of an individual residential unit separated from other residential units, yet maintaining an enclosed passageway interconnecting the units for protection from the weather.

Whereas the invention has been shown and described in connection with the preferred embodiment thereof, it will be understood that many modifications, substitutions and additions may be made which are within the intended broad scope of the appended claims.

We claim:

1. A system of integrated residential dwelling units, comprising:

first and second dwelling units, each having a forward side facing first and second generally parallel streets, respectively, and each dwelling unit including an opposite rearward side, and opposing side walls;

said first and second dwelling units located with their forward sides facing in generally opposite directions and their rearward sides adjacent one another;

an enclosed passageway connecting the rearward sides of said first and second dwelling units, said passageway having at least one entryway from a exterior of said passageway, said entryway located externally of said dwelling units;

each said dwelling unit including a rearward entry in said rearward side accessing said passageway, and a separate forward entry accessing the street in front of the dwelling unit said first and second dwelling units forming a first pair of dwelling units.

2. The system of claim 1, further comprising:

a second pair of dwelling units, including a third and fourth dwelling unit, each dwelling unit having a forward side facing said first and second streets, respectively, and each dwelling unit including an opposite rearward side, and opposing side walls;

said third and fourth dwelling units having their rearward sides adjacent one another, and spaced apart;

said second pair of units spaced from said first pair of units and separated therefrom by a green space;

said enclosed passageway extending from said first pair of units through said green space and connecting the rearward sides of said third and fourth unit; and each of said third and fourth dwelling units including a rearward entry in said rearward side accessing said passageway, and a separate forward entry accessing the street in front of the dwelling unit.

3. The system of claim 1, further comprising:

an enclosed commons building having a forward side facing said first street, said commons building being spaced from said first pair of units and separated therefrom by a green space;

said enclosed passageway extending from said first pair of units through said green space and connected to said commons building; and said commons building including an entry accessing said passageway, and a separate forward entry accessing said first street.

4. The system of claim 2 further comprising:

an enclosed commons building having a forward side facing said first street;

said commons building located intermediate said first and second pairs of dwelling units and separated therefrom by green space;

said enclosed passageway extending from each of said first and second pairs of units and connected to said commons building;

said commons building including an entry accessing said passageway, and a separate forward entry accessing said first street.

5. The system of claim 1, wherein each dwelling unit has a green space located along at least a portion of each its opposing side walls.

6. The system of claim 1, wherein each dwelling unit includes a kitchen area, a living area, a sleeping area, a bathroom area, and an attached garage.

7. A system of integrated residential dwelling units, comprising:

a first pair of dwelling units including a first and second dwelling unit, each dwelling unit having a forward side facing a first street, an opposing rearward side, and opposing side walls;

said first and second dwelling units each including a forward portion and a rearward portion, said rearward portions sharing a common side wall and a common rearward wall;

said forward portions of said first and second dwelling units being spaced apart and separated by green space;

the side wall of each dwelling unit which is opposite the common side wall, having a green space located along its entire length;

an enclosed passageway connecting the rearward sides of said first and second dwelling units, said passageway having at least one entryway from an exterior of said passageway, said entryway located separate from and externally of said dwelling units; and each said dwelling unit including a rearward entry in said rearward side accessing said passageway, and a separate forward entry accessing the first street.

8. The system of claim 7, further comprising:

a second pair of dwelling units including third and fourth dwelling units, each dwelling unit having a forward side facing a second street located parallel from the first street, and each dwelling unit including an opposite rearward side and opposing side walls;

said third and fourth dwelling units each including a forward portion and a rearward portion, said rearward portions sharing a common side wall and a common rearward wall;

said forward portions of said third and fourth dwelling units being spaced apart and separated by a green space;

the side wall of each dwelling unit which is opposite the common side wall, having a green space located along its entire length;

said second pair of dwelling units spaced from said first pair of units and oriented with the rearward common wall of the second pair parallel and adjacent the rearward common wall of the first pair of dwelling units;

said enclosed passageway enclosing the rearward sides of the first and second pairs of dwelling units;

each of said third and fourth dwelling units including a rearward entry in said rearward side accessing said passageway, and a separate forward entry accessing the second street in front of the dwelling unit.

9. The system of claim 7, further comprising:

an enclosed commons building having a forward side facing said street, said commons building being spaced from said first pair of dwelling units and separated therefrom by green space;

said enclosed passageway extending from said first pair of units through said green space and connected to said commons building;

said commons building including an entry accessing said passageway, and a separate forward entry accessing said street.

10. The system of claim 8, further comprising:

an enclosed commons building having a forward side facing said first street;

said commons building being spaced from said first and second pair of units and separated therefrom by a green space;

said enclosed passageway extending from said first and second pairs of dwelling units through said green space and connected to said commons building; and said commons building including an entry accessing said passageway, and a separate forward entry accessing said first street.

* * * * *

UNITED STATES PATENT AND TRADEMARK OFFICE

CERTIFICATE OF CORRECTION

PATENT NO. : 5,469,673

DATED : November 28, 1995

INVENTOR(S) : Dennis L. Raynor and Dennis J. Hoth

It is certified that error appears in the above-identified patent and that said Letters Patent is hereby corrected as shown below:

Please delete claims 1, 2 and 3, from Column 3, line 29 through Column 4, line 11, and substitute the following:

--1. A system of integrated residential dwelling units comprising:

first and second dwelling units, each having a forward side facing first and second generally parallel streets, respectively, and each dwelling unit including an opposite rearward side, and opposing side walls;

said first and second dwelling units located with their forward sides facing in generally opposite directions and their rearward sides adjacent one another;

an enclosed passageway connecting the rearward sides of said first and second dwelling units, said passageway having at least one entryway from an exterior of said passageway, said entryway separate from and externally of said dwelling units;

each said dwelling unit including a rearward entry in said rearward side accessing said passageway, and a separate forward entry accessing the street in front on the dwelling unit;

a second pair of dwelling units, including a third and fourth dwelling unit, each dwelling unit having a forward side facing said first and second streets, respectively, and each dwelling unit including an opposite rearward side, and opposing side walls;

said third and fourth dwelling units having their rearward sides adjacent one another, and spaced apart;

said second pair of units spaced from said first pair of units and separated therefrom by a green space;

said enclosed passageway extending from said first pair of units through said green space and connecting the rearward sides of said third and fourth unit; and each of said third and fourth dwelling units including a rearward entry in said rearward side accessing said passageway, and a separate forward entry accessing the street in front of the dwelling unit.--

UNITED STATES PATENT AND TRADEMARK OFFICE

CERTIFICATE OF CORRECTION

PATENT NO. : 5,469,673

DATED : November 28, 1995

INVENTOR(S) : Dennis L. Raynor and Dennis J. Hoth

It is certified that error appears in the above–identified patent and that said Letters Patent is hereby corrected as shown below:

--2. A system of integrated residential dwelling units, comprising:

first and second dwelling units, each having a forward side facing first and second generally parallel streets, respectively, and each dwelling unit including an opposite rearward side, and opposing side walls;

said first and second dwelling units located with their forward sides facing in generally opposite directions and their rearward sides adjacent one another;

an enclosed passageway connecting the rearward sides of said first and second dwelling units, said passageway having at least one entryway from an exterior of said passageway, said entryway separate and externally of said dwelling units;

each said dwelling unit including a rearward entry in said rearward side accessing said passageway, and a separate forward entry accessing the street in front of the dwelling unit;

an enclosed commons building having a forward side facing said first street, said commons building being spaced from said first pair of units and separated therefrom by a green space;

said enclosed passageway extending from said first pair of units through said green space and connected to said commons building; and said commons building including an entry accessing said passageway, and a separate forward entry accessing said first street.--

In Column 4, line 12, change "4" to –3–, and change "2" to –1–.

In Column 4, lines 24-29, delete claims 5 and 6 and substitute the following:

UNITED STATES PATENT AND TRADEMARK OFFICE

CERTIFICATE OF CORRECTION

PATENT NO. : 5,469,673

DATED : November 28, 1995

INVENTOR(S) : Dennis L. Raynor and Dennis J. Hoth

It is certified that error appears in the above-identified patent and that said Letters Patent is hereby corrected as shown below:

-- 4. A system of integrated residential dwelling units, comprising:

first and second dwelling units, each having a forward side facing first and second generally parallel streets, respectively, and each dwelling unit including an opposite rearward side, and opposing side walls;

said first and second dwelling units located with their forward sides facing in generally opposite directions and their rearward sides adjacent one another;

an enclosed passageway connecting the rearward sides of said first and second dwelling units , said passageway having at least one entryway from an exterior of said passageway, said entryway separate and externally of said dwelling units;

each said dwelling unit including a rearward entry in said rearward side accessing said passageway, and a separate forward entry accessing the street in front of the dwelling unit;

each dwelling unit having a green space located along its opposing side walls. --

In Column 4, line 30, change "7" to --5--.
In Column 4, line 53, change "8" to --6-- and "7" to --5--.
In Column 5, line 17, change "9" to --7-- and "7" to --5--.

UNITED STATES PATENT AND TRADEMARK OFFICE

CERTIFICATE OF CORRECTION

PATENT NO. : 5,469,673 Page 4 of 4

DATED : November 28, 1995

INVENTOR(S) : Dennis L. Raynor, et al

It is certified that error appears in the above-indentified patent and that said Letters Patent is hereby corrected as shown below:

Column 6, line 7, change "10" to —8— and "8" to —6—.

Signed and Sealed this

Twenty-sixth Day of March, 1996

Bruce Lehman

*Attest:*

BRUCE LEHMAN

*Attesting Officer*

*Commissioner of Patents and Trademarks*